US005761786A

United States Patent [19]

Simons

[11] Patent Number: 5,761,786

[45] Date of Patent: Jun. 9, 1998

[54] METHOD OF RETROFITTING A SLIDING DRAWER WITHIN AN EXISTING CABINET

[75] Inventor: Thomas William Simons, Green Valley, Ariz.

[73] Assignee: Venwest Business Acquisition Fund Limited Partnership, Tucson, Ariz.

[21] Appl. No.: 332,913

[22] Filed: Nov. 1, 1994

Related U.S. Application Data

[63] Continuation of Ser. No. 179,769, Jan. 10, 1994, Pat. No. 5,421,647, which is a continuation of Ser. No. 933,023, Aug. 20, 1992, abandoned.

[51] Int. Cl.[6] ..... B21K 21/16

[52] U.S. Cl. ..... 29/401.1; 29/434; 312/265.1

[58] Field of Search ..... 29/401.1, 434, 29/469

[56] References Cited

U.S. PATENT DOCUMENTS

| | | | |
|---|---|---|---|
| 2,620,251 | 12/1952 | Restivo . | |
| 3,178,244 | 4/1965 | Reiss et al. . | |
| 3,275,394 | 9/1966 | Massinger . | |
| 3,370,521 | 2/1968 | Honerkamp . | |
| 3,393,951 | 7/1968 | Sulentic . | |
| 3,497,279 | 2/1970 | Chovanec . | |
| 3,612,633 | 10/1971 | Bloom . | |
| 3,612,634 | 10/1971 | Moore, Jr. . | |
| 3,712,698 | 1/1973 | Propst et al. . | |
| 3,716,284 | 2/1973 | Vogt . | |
| 3,720,995 | 3/1973 | Brown et al. | 29/269 |
| 3,844,634 | 10/1974 | Kruger et al. . | |
| 3,963,290 | 6/1976 | Rennemann . | |
| 3,970,010 | 7/1976 | Cantley . | |
| 4,126,364 | 11/1978 | Reilly . | |
| 4,191,436 | 3/1980 | Cherry . | |
| 4,231,626 | 11/1980 | Amtmann et al. . | |
| 4,283,099 | 8/1981 | Burton . | |
| 4,288,130 | 9/1981 | Baldwin . | |
| 4,453,790 | 6/1984 | Coben et al. . | |
| 4,653,818 | 3/1987 | DeBruyn . | |
| 4,728,159 | 3/1988 | Solomon et al. . | |
| 4,941,717 | 7/1990 | Beaulieu . | |
| 5,102,210 | 4/1992 | Beals . | |
| 5,152,595 | 10/1992 | Zaccone . | |
| 5,251,973 | 10/1993 | Hazan . | |

FOREIGN PATENT DOCUMENTS

| | | | |
|---|---|---|---|
| 601926 | 2/1960 | Italy | 312/330.1 |

OTHER PUBLICATIONS

Vauth–Sagel catalog, Nov. 1991, p. 97.

Hafele America Co./Feeny Manufacturing Company/FGV America brochures, Circa 1985, various pages.

"Kitchen Accessories & Connector Fittings" brochure, Vasa America Inc. (circa Jul. 1993).

Drawer Slide Accessories, Page from Hardware Catalog (B–44).

Miscellaneous Hardware, Page from Hardware Catalog (G. 19).Louis and Company.

*Primary Examiner*—David P. Bryant

*Attorney, Agent, or Firm*—Merchant, Gould, Smith, Edell Welter & Schmidt

[57] ABSTRACT

An apparatus and method are disclosed for supporting drawers within a cabinet while relying solely on the floor of the cabinet for support. The preferred apparatus includes a pair of opposing vertical support members, a pair of horizontal stability members, and one or more sliding drawers. The vertical support members are adapted for mounting on the storage cabinet floor, horizontal base, or other platform located within a storage cabinet. Tabs are included on the vertical support members for attaching the horizontal stability members, although the drawers themselves might be used for horizontal support. The vertical support members are arranged and configured such that the width between them can vary depending on the size of drawer desired.

16 Claims, 2 Drawing Sheets

METHOD OF RETROFITTING A SLIDING DRAWER WITHIN AN EXISTING CABINET

This is a continuation of U.S. patent application Ser. No. 08/179,769, filed Jan. 10, 1994 (now U.S. Pat. No. 5,421,647), which was a continuation of U.S. patent application Ser. No. 07/933,023, filed Aug. 20, 1992 (now abandoned).

FIELD OF THE INVENTION

The present invention relates generally to an apparatus suitable for storing articles, and more particularly to a stand-alone sliding drawer apparatus of the type suitable for use within storage cabinets.

BACKGROUND OF THE INVENTION

Drawer support devices commonly employed in household storage cabinets rely on the sides of the cabinet for support and guidance of the inserted drawers. For example, the runners which guide and support the drawers are typically fastened directly to the interior sides of the cabinet. This practice, however, presents several difficulties. First, this technique cannot be used in cabinets that have center supports or in cabinets that are not "square" (e.g., cabinets wherein the sides are not oriented at ninety degree angles with respect to the front and back sides). Second, even if the cabinets have the requisite shape and style, this technique produces permanent alterations in the cabinet. As a result, a person cannot easily remove the support device because of the permanent marks on the cabinet sidewalls. Third, the materials utilized in the sidewalls are often not sized or constructed to provide the stability to function as the support.

There have been several attempts to provide support structures which are not connected to sidewalls inside of a locker—for example in the situation where the installer does not own the locker and so is prohibited from marring, permanently altering, or otherwise defacing the locker. Examples of these references include U.S. Pat. No. 4,283,099 issued to Burton and U.S. Pat. No. 3,612,633 issued to Bloom. Burton generally discloses a cabinet having sidewalls to support drawers and shelves. The sidewalls of the cabinet are not connected to the sidewalls of the enclosure (i.e., the locker) into which the cabinet is placed. Bloom discloses a shelf support kit wherein shelves are supported by vertical members connected to horizontal shelf support members. Shelf support is provided by the vertical members which are not connected to the sidewalls. However, each of these references suffers from the drawback that they are sized for a single enclosure and do not utilize sliding drawers. Therefore, retrofitting within various sized cabinets would be impossible, absent having a large number of unrelated sized supports and shelves.

Other art includes U.S. Pat. No. 4,191,136 issued to Cherry which discloses a cabinet for use in a mobile vehicle. Support for horizontal runners is provided by vertical members. The device also uses horizontal stabilizers which are located between the vertical members. Further, U.S. Pat. No. 4,453,790 issued to Cohen et al. discloses a cabinet having horizontal runners supported by vertical members, and horizontal stabilizers located between vertical members. Cohen also illustrates two drawers which are located side by side in the cabinet. The preceding two devices, however, do not disclose vertical support members which may be placed at various widths from each other and which are supported only by the surface on which the vertical support members are located.

Therefore, there is a need for a new and improved sliding drawer apparatus and method for use within variously sized storage cabinets, and which may be constructed as part of the enclosure or which may be retrofit into such enclosures.

SUMMARY OF THE INVENTION

The present invention proposes a novel solution for supporting drawers while solving many of the above described problems. Since the preferred apparatus relies solely on the floor of the cabinet for support, it can support heavier objects, it can be used in cabinets which are not square, and it can be utilized in cabinets of any size or shape. Moreover, this apparatus leaves no marking on the sidewalls of the cabinet and can be easily disassembled and incorporated into new cabinets.

In a preferred embodiment of an apparatus constructed according to the principles of the present invention, the sliding drawer apparatus comprises a pair of opposing vertical support members, a pair of horizontal stability members, and one or more sliding drawers. The vertical support members are adapted for mounting on the storage cabinet floor (or such other horizontal base/platform located within a storage cabinet). Additionally, the vertical support members preferably include tabs for fastening the horizontal stability members. The vertical support members are arranged and configured such that the horizontal stability members can vary in length.

The vertical support members normally oppose one another, but can be placed at varying widths apart in order to compensate for the varying storage cabinet sizes into which the apparatus can be placed. Optionally, a third vertical support member may be located between the first and second vertical support members in order to include smaller width sliding drawers within the storage cabinet. The vertical support members are arranged and configured to carry horizontal guides for supporting the drawers.

One feature of the present invention is that the apparatus may be installed in a cabinet of any size, and in fact does not rely on any of the sidewalls of the cabinet for support. This allows for the apparatus to carry heavier objects and support more weight, regardless of the cabinet construction.

Another feature of the present apparatus is that it is rectangular in shape and can support one or more drawers depending on the size of the cabinet. Similarly, one cabinet can have two or more apparatus side-by-side, contained within the same cabinet.

Still another feature of the present invention is that since the vertical support members are affixed to the base of the storage cabinet, only two horizontal stability members need to be utilized (i.e., one at the front and one at the rear of the vertical support members). The continuity of the base provides the necessary spacing required by the vertical support members at the bottom of the apparatus to keep them at the proper distance away from one another. It will be appreciated that the proper spacing is required in order to keep the sliding drawers from binding when in use.

Therefore, according to one aspect of the invention there is provided an apparatus for supporting drawers in an enclosure of the type having a base and sides, comprising: a pair of oppositely disposed vertical support members, wherein said vertical support members are arranged and configured with the drawer located therebetween; a horizontal runner for guiding and supporting drawers being operatively connected to said vertical support member; a horizontal stability member, operatively connected substantially near the tops of said vertical support members, which connects and maintains the upper ends of said vertical support members at a predetermined distance apart; and means for securing the bases of said vertical support members to the base of the enclosure, whereby said vertical support members rely on the base of the enclosure, rather than the sides, for support.

Further, according to another aspect of the invention there is provided an apparatus for supporting drawers in an enclosure comprising: two pair of oppositely disposed metal vertical support members arranged so a drawer can be located therebetween; a horizontal mounting tab operatively connected to the base of each vertical support member at a right angle and having at least one hole or aperture which allows said horizontal mounting tab to be fixed to the base of the enclosure; a vertical tab operatively connected within 1½ inches from the top of each vertical support member protruding out at substantially a right-angle from said vertical support member having at least one hole or aperture; a wooden horizontal stability member connecting the tops of two adjacent said vertical support members by being operatively connected at right angles within 1½ inches from the tops of said vertical support members by being fastened to said vertical tabs with metal screws or bolts; and at least one pair of runners which guide the drawers in and out of the apparatus, whereby said runners are operatively connected to said vertical support members by a fastening device.

According to still another aspect of the invention, there is provided an apparatus for supporting drawers in an enclosure, the enclosure being of the type having a floor and a sidewall, where the floor serves to provide horizontal stability at the base of the apparatus comprising: a pair of oppositely disposed vertical support members, wherein said vertical support members are arranged and configured with the drawer located therebetween; horizontal runner means for guiding and supporting drawers, said runner means being operatively connected to said vertical support members; a horizontal stability member, operatively connected to the tops or substantially near the tops of said vertical support members, which connects and keeps the upper ends of said vertical support members at a predetermined distance apart; and means for securing the bases of said vertical support members to the base of the enclosure, whereby said vertical support members rely on the base of the enclosure, rather than the sides for support.

These and other advantages and features which characterize the present invention are pointed out with particularity in the claims annexed hereto and forming a further part hereof. However, for a better understanding of the invention, its advantages and objects attained by its use, reference should be made to the drawing which forms a further part hereof and to the accompanying descriptive matter, in which there is illustrated and described a preferred embodiment of the present invention.

BRIEF DESCRIPTION OF THE DRAWING

In the Drawing, wherein like parts are referenced by like numerals throughout the several views.

DETAILED DESCRIPTION OF THE PREFERRED EMBODIMENT

The principles of this invention apply particularly well to constructing shelving within original and existing storage cabinets. A preferred application for this invention is retrofitting sliding drawers within existing kitchen cabinets. The most common type of kitchen cabinet is referred to as "face frame" or "faceless" style cabinets. Such preferred application, however, is typical of only one of the innumerable types of applications in which the principles of the present invention can be employed.

Figures 1, 2:
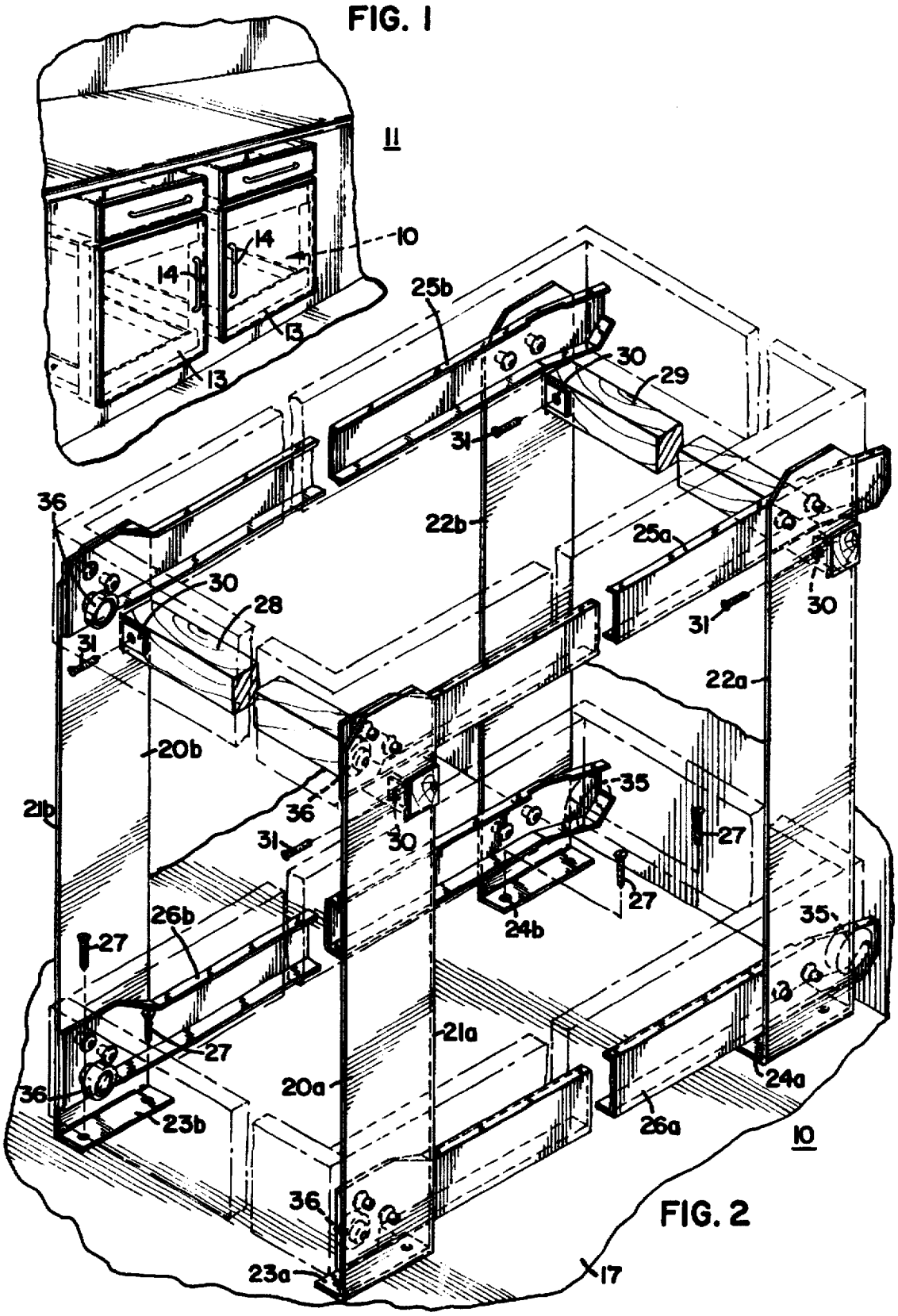
FIG. 1 is a perspective view of a storage cabinet of the type in which a preferred embodiment of the present invention may be utilized, with an embodiment of the present invention illustrated in phantom.
FIG. 2 is a perspective view of a preferred embodiment of a drawer support apparatus constructed according to the principles of the present invention, with portions broken away and in phantom.
Figure 3:
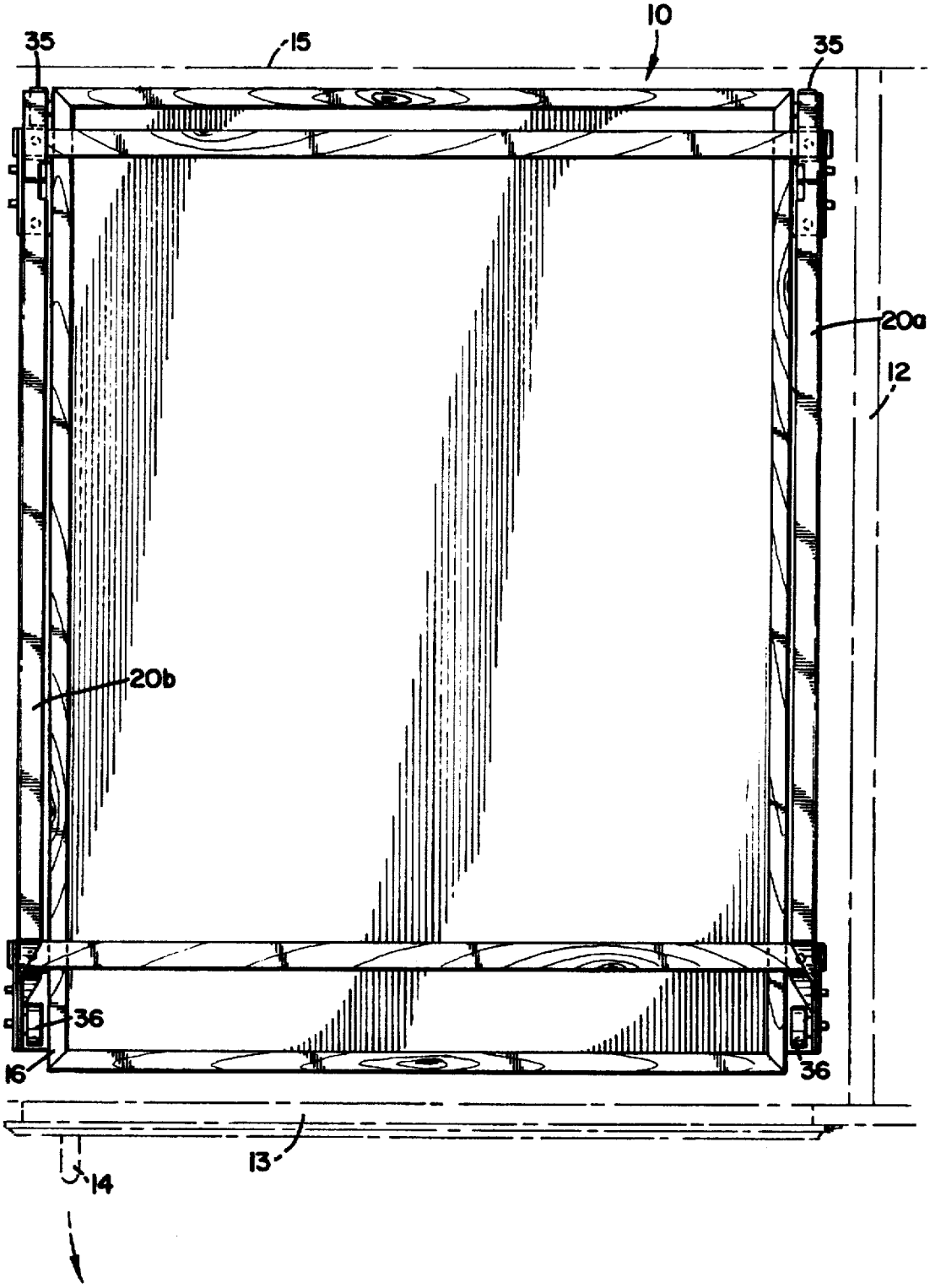
FIG. 3 is a top plan view of the drawer support apparatus of FIG. 2, with portions of the cabinet into which the apparatus may be placed shown in phantom.

As shown in FIGS. 1, 2, and 3, the present invention is a drawer support apparatus 10 which may be installed in a cabinet 11 of virtually any size and shape. It will become apparent upon further review of the specification and drawing that the apparatus 10 does not rely on any of the back walls 15 or sidewalls 12 of the cabinet 11 for support. Therefore, the materials, material strength, thickness, and whether the walls are square can be effectively ignored while installing and utilizing the apparatus 10.

The apparatus 10 is generally rectangular in shape (including a square shape) and can support one or more drawers 16, depending in part on the size of the cabinet 11 and the size of desired drawers. Similarly, one cabinet 11 can have multiple apparatuses 10 in a side-by-side configuration, contained in the cabinet 11 (best seen in FIG. 1). The apparatus 10 is comprised of at least one pair of vertical support members **20*a* and 20*b*. These support members 20*a* and 20*b* are preferably mirror images of one another, and so only support member 20*a*** will be discussed in detail herein.

Support member **20*a* comprises two opposing metal elongated columns 21*a* and 22*a* which are arranged and configured to include a horizontal mounting flange 23*a* and 24*a* respectively at a first end and a mounting means 30 for a horizontal stability member 28, 29 proximate the second end. Additionally, each of the elongated columns 21*a* and 22*a* are configured to receive sliding channels, or horizontal runners, 25*a*, 26*a* to engage rails/protrusions (not shown) fixed to the drawer 16. Preferably, these runners 25*a*, 26*a* are adapted to receive rotatable wheels 35 located on the rear end of the drawers 16 and further include a wheel 36 affixed to the front end of the support member 20*a* on which the drawer protrusion rides. The runners 25*a*, 26*a* used in the sliding drawer apparatus 10** are well known in the art and so will not be described further herein. In a preferred embodiment, the horizontal runners utilized are channel guides manufactured by Grass America, of Kernsville, N.C., having a model designation of G-6600-18AL (wherein the last designation is the width desired and the color; e.g., 18AL designates 18 inches long and almond).

When the two elongated columns **21*a* and 22*a* are connected together with the runners 25*a*, 26*a*, then the entire resulting vertical support member 20*a* generally lies within the same plane. However, the horizontal mounting flanges 23*a* and 24*a* extend generally at a right angle with respect to the plane formed by the elongated columns 21*a*, 22*a* and channel guides 25*a*, 26*a***.

It will be appreciated by those skilled in the art that the references in the description of the apparatus 10 to top, bottom, front, and back refer to the normal orientation of the apparatus when installed within a cabinet 11. Therefore, top and bottom are relative to the floor/base 17 of the cabinet 11, while front and back are relative to the door 13 (i.e., the back is that end of the apparatus which is closest to the rear wall 15).

The preferred embodiment includes four metal elongated columns **21*a*, 22*a*, 21*b*, 22*b* located near each corner of the cabinet 11. However, since these do not need to be connected to the sidewalls 12 or rear walls 15 of the cabinet 11, it is not necessary that they be in the four corners. As those skilled in the art will appreciate, the columns 21***a*, 22*a*, 21*b*, 22*b* may be situated in any particular part of the cabinet 11 so that the drawers 16 can slide between the vertical support members 20*a* and 20*b*. An alternative to having four elongated columns 21*a*, 22*a*, 21*b*, 22*b* is to utilize one pair of vertical support members or two or more pairs of vertical support members.

The vertical support members 20*a* and 20*b* are secured to the floor 17 of the cabinet by horizontal mounting flanges 23*a*, 24*a*, 23*b*, 24*b* which are operatively connected to the first end of each elongated column 21*a*, 22*a*, 21*b*, 22*b*. The preferred embodiment includes integral horizontal mounting flanges. However, various alternatives include these flanges 23*a*, 24*a*, 23*b*, 24*b* being operatively connected by fasteners—such as screws and bolts, etc. Each horizontal mounting flange 23*a*, 24*a*, 23*b*, 24*b* includes a means for securing it to the base 17 of the cabinet 11. The preferred embodiment comprises two or more holes which allows screws 27 to be used to fasten this apparatus 10 to the base 17 of the cabinet 11. However, nails and other fastening means could similarly be used as is well known in the art.

Securing the bases/first ends of the elongated columns 21*a*, 22*a*, 21*b* and 22*b* to the base 17 of the cabinet 11 ensures stability for the lower portion (i.e., the first end) of the elongated columns 21*a*, 22*a*, 21*b* and 22*b*. However, for further stability, horizontal stability members 28 and 29 connect the two vertical support members 20*a*, 20*b* near their tops. Each horizontal stability member 28 and 29 connects two elongated columns, 21*a* and 21*b*, and 22*a* and 22*b*, respectively, together.

The horizontal stability members 28, 29 assure that the vertical support members 20*a*, 20*b* remain at a constant distance apart from each other. The horizontal stability members 28, 29 are connected to the vertical support members 20*a*, 20*b* by a fastening apparatus that can either be connected to the horizontal support members 28, 29 or the vertical stability members 20*a* and 20*b*. The preferred embodiment is a mounting tab 30 integrally connected to each of the elongated columns 21*a*, 22*a*, 21*b* and 22*b*. Tab 30 provides a means for engaging a fastening device such as a screw 31, or bolt to operatively connect the horizontal stability member 28 and 29 together with the elongated columns 21*a*, 22*a*, 21*b* and 22*b*.

When the horizontal stability members 28 and 29 are in place, the vertical supports are generally oriented at a 90 degree angle from the floor 17. It should be noted, that a horizontal stability member 28 connects the front of the pair of vertical supports 20*a*, 20*b*, and a second horizontal stability member 29 connects the back of the pair of vertical supports 20*a*, 20*b*. The preferred embodiment utilizes a wooden horizontal stability member. However, the horizontal stability member can be made of different materials such as plastic and metals as well, so long as the desired structural support is achieved.

As noted above, a number of horizontal runners 25*a*, 26*a*, 25*b* and 26*b* are connected to the vertical support members 20*a*, 20*b* for guiding and supporting drawers 16. These runners 25*a*, 26*a*, 25*b*, 26*b* are operatively connected to the vertical support members by a fastening means, such as rivets, screws, bolts, etc. Each pair of runners 25*a–b* and 26*a–b* is used to guide and support a single drawer 16, therefore if two or more drawers 16 are desired, two or more pairs of runners 25*a–b*, 26*a–b* must be connected to the vertical support members 20*a*, 20*b*.

In operation, first the proper length slides 25*a–b* and 26*a–b* are selected for the depth of the cabinet 11. The slides are then assembled to the columns 21*a*, 22*a*, 21*b*, 22*b* preferably with rivets or other fasteners to comprise the vertical support members 20*a*, 20*b*. Next, the assembled support members 20*a* and 20*b* are placed within the cabinet 11 structure. The width of the drawer 16 is then established between the selected vertical support members 20*a*, 20*b* and the drawer 16 is placed in the bottom runners 26*a* and 26*b* to maintain the support members 20*a* and 20*b* at the correct distance apart. A second drawer is placed in runners 25*a* and 25*b* to maintain the proper distance at the top (i.e., the second end of the support columns 21*a*, 22*a*, 21*b*, 22*b*). Horizontal stability members 28 and 29 are then inserted utilizing screws 31.

The top drawer 16 and bottom drawer 16 are then removed from the apparatus 10. When done carefully, the lower portions of the support members 20*a* and 20*b* remain at the same location and desired distance apart relative to the base 17 of the cabinet 11. However, for exacting installations, a template or other method of marking the location of the flanges 23*a*, 24*a*, 23*b*, 24*b* may aid installation. Screws 27 may then be placed directly into the floor 17, the drawers 16 reinserted, items placed within the drawers 16, and the cabinet doors 13 closed via handles 14. As will be appreciated, preferably the drawers 16 are slidable out through the opened storage doors 13.

It is to be understood that even though numerous characteristics and advantages of the present invention have been set forth in the foregoing description, together with details of the structure and function of the invention, the disclosure is illustrative only and changes may be made in detail, especially in matters of the location of the elongated columns 21*a*, 22*a*, 21*b*, 22*b* and the fastening arrangement of the horizontal stability members 28 and 29 to the vertical support members 20*a* and 20*b*. Other modifications and alterations are well within the knowledge of those skilled in the art and are to be included within the broad scope of the appended claims.

What is claimed is:

1. A method of retrofitting a sliding drawer within an existing cabinet having a height, a width, a depth, and a floor, comprising the steps of:

selecting a pair of slides of appropriate length according to the depth of the existing cabinet;

securing each of the pair of slides to and between a respective pair of columns to form a pair of support members, each having a slide extending substantially perpendicularly relative to its respective pair of columns;

placing the pair of support members within the existing cabinet;

selecting a drawer of appropriate width and appropriate length according to the width and the length of the existing cabinet;

operatively connecting the drawer to the slides to maintain the pair of support members at an appropriate distance from one another;

determining locations of the support members relative to one another in the existing cabinet based upon the width of the drawer; and securing the support members to the floor of the existing cabinet, and wherein the support members are secured only to the floor of the existing cabinet after removing the drawer from the slides in a manner that does not materially affect the location of the support members relative to the existing cabinet.

2. A method according to claim 1, further comprising the step of again operatively connecting the drawer to the slides after securing the support members to the floor of the existing cabinet.

3. A method according to claim 1, further comprising the step of marking locations of the columns relative to the floor of the existing cabinet before removing the drawer from the slides.

4. A method according to claim 1, further comprising the step of securing a horizontal stability member to and between the support members before securing the support members to the floor of the existing cabinet, such that the horizontal stability member extends substantially perpendicular relative to the slides and the columns.

5. A method according to claim 4, further comprising the step of selecting a horizontal stability member of appropriate length according to the width of the existing cabinet.

6. A method according to claim 1, wherein the step of securing the support members to the floor of the existing cabinet involves driving screws through horizontally extending flanges on the columns and into the floor of the existing cabinet.

7. A method of retrofitting a sliding door within an existing cabinet having a height, a width, a depth, and a floor, comprising the steps of:

(a) selecting a pair of slides of appropriate length according to the depth of the existing cabinet;

(b) securing each of the pair of slides to and between a respective pair of columns to form a pair of support members, each having a slide extending substantially perpendicularly relative to its respective pair of columns;

(c) selecting a second pair of slides of appropriate length according to the depth of the existing cabinet;

(d) securing each of the second pair of slides between the respective pair of columns to form a pair of support members, each having two slides extending substantially perpendicularly relative to its respective pair of columns;

(e) placing the pair of support members within the existing cabinet;

(f) selecting a drawer of appropriate width and appropriate length according to the width and the length of the existing cabinet;

(g) operatively connecting the drawer to the slides to maintain the pair of support members at an appropriate distance from one another;

(h) selecting a second drawer of appropriate width and appropriate length according to the width and the length of the existing cabinet; and (i) operatively connecting the second drawer to the second slides to maintain the pair of support members at an appropriate distance from one another;

(j) determining locations of the support members relative to one another in the existing cabinet based upon the width of the drawer; and (k) securing the support members to the floor of the existing cabinet, and wherein the support members are secured only to the floor of the existing cabinet after removing the drawer from the slides in a manner that does not materially affect the location of the support members relative to the existing cabinet.

8. A method of retrofitting a sliding drawer within an existing cabinet having a floor with a floor width and a floor depth, comprising the steps of:

selecting a drawer with a drawer width less than the floor width and a drawer depth less than the floor depth;

selecting a first drawer slide suitable for the drawer depth;

securing the first drawer slide to a first pair of columns to extend substantially perpendicular relative thereto;

selecting a second drawer slide suitable for the drawer depth;

securing the second drawer slide to a second pair of columns to extend substantially perpendicular relative thereto;

placing the pairs of columns within the existing cabinet;

operatively connecting the drawer to the drawer slides to establish the pair of columns at an appropriate distance from one another;

removing the drawer from the pair of columns in a manner that does not materially affect the established location of the pair of columns; and securing the pairs of columns to the floor of the existing cabinet, so that the first pair of columns is spaced approximately the drawer width apart from the second pair of columns.

9. A method according to claim 8, wherein the step of securing the pairs of columns to the floor of the existing cabinet involves driving screws through horizontally extending flanges on the columns and into the floor of the existing cabinet.

10. A method according to claim 8, wherein said first drawer slide is connected only to said first pair of columns, and said first pair of columns are connected only to the floor of the existing cabinet, and said second drawer slide is connected only to said second pair of columns, and said second pair of columns are connected only to the floor of the existing cabinet.

11. A method according to claim 8, wherein the step of securing the pairs of columns to the floor of the existing cabinet is the only step involving interconnection between any of the columns and any of the existing cabinet.

12. A method of retrofitting a sliding drawer within an existing cabinet having a cabinet height and a cabinet floor, comprising the steps of:

configuring four metal L-shaped members so that each has a relatively longer segment that is shorter than the cabinet height, a relatively shorter segment, and at least one hole formed through the shorter segment;

securing a first drawer guide to and between a first pair of the L-shaped members in such a manner that a drawer receiving channel on the first drawer guide opens in substantially the same direction as the shorter segments extend from the longer segments on the first pair of L-shaped members;

securing a second drawer guide to and between a second pair of the L-shaped members in such a manner that a drawer receiving channel on the second drawer guide opens in substantially the same direction as the shorter segments extend from the longer segments on the second pair of L-shaped members;

positioning the first drawer guide and the second drawer guide in the existing cabinet so that the drawer receiving channels open toward one another and so that the first drawer guide and the second drawer guide are separated by approximately the drawer width;

operatively connecting a drawer to the first drawer guide and the second drawer guide to establish the position of the first drawer guide and the second drawer guide within the existing cabinet; and moving fasteners through the holes in the shorter segments and into the cabinet floor after removing the drawer from the first drawer guide and second drawer guide in a manner which does not materially affect the established position.

13. A method according to claim 12, wherein the steps of securing a first drawer guide to and between a first pair of the L-shaped members, and securing a second drawer guide to and between a second pair of the L-shaped members involve doing so in such a manner that when the drawer is operatively connected to the first drawer guide and the second drawer guide, the drawer slides along the drawer guides at a distance above the shorter segments.

14. A method according to claim 12, wherein the step of moving fasteners through the holes in the shorter segments and into the cabinet floor is the only step which involves securing any structure associated with the sliding drawer relative to the existing cabinet.

15. A method according to claim 12, further comprising the step of securing a horizontal stability member to and between the first pair of L-shaped members and the second pair of L-shaped members.

16. A method of retrofitting a sliding drawer within an existing cabinet having a height, a width, a depth, and a floor, comprising the steps of:

selecting a pair of slides of appropriate length according to the depth of the existing cabinet;

securing each of the pair of slides to and between a respective pair of columns to form a pair of support members, each having a slide extending substantially perpendicularly relative to its respective pair of columns;

placing the pair of support members within the existing cabinet;

selecting a drawer of appropriate width and appropriate length according to the width and the length of the existing cabinet;

operatively connecting the drawer to the slides to maintain the pair of support members at an appropriate distance from one another;

securing the support members to the floor of the existing cabinet, and wherein the support members are secured only to the floor of the existing cabinet; and removing the drawer from the slides in a manner that does not materially affect the location of the support members relative to the existing cabinet before securing the support members to the floor of the existing cabinet.

* * * * *